United States Patent [19]

Roberts et al.

[11] Patent Number: 4,504,814

[45] Date of Patent: Mar. 12, 1985

[54] HOUSING FOR A BIMETALLIC THERMAL SWITCH

[75] Inventors: Charles C. Roberts; Jeffrey R. Wright, both of Frederick, Md.

[73] Assignee: U.S. Philips Corporation, New York, N.Y.

[21] Appl. No.: 363,678

[22] Filed: Mar. 30, 1982

[51] Int. Cl.[3] ..... H01H 71/16

[52] U.S. Cl. ..... 337/112; 337/380

[58] Field of Search ..... 337/354, 342, 343, 349, 337/372, 380, 379, 112, 113, 333, 362, 381

[56] References Cited

U.S. PATENT DOCUMENTS

| | | | |
|---|---|---|---|
| 3,096,417 | 7/1963 | Odenwald | 337/379 X |
| 3,227,845 | 1/1966 | Barz | 337/354 |
| 3,256,413 | 6/1966 | Mertler | 337/379 X |
| 3,649,943 | 3/1972 | Matto | 337/380 |
| 3,878,499 | 4/1975 | Concin | 337/380 X |
| 3,956,677 | 5/1976 | Quick | 361/308 |

FOREIGN PATENT DOCUMENTS

| | | | |
|---|---|---|---|
| 1214252 | 12/1970 | United Kingdom | 337/354 |

OTHER PUBLICATIONS

IBM Technical Disclosure Bulletin, vol. 14, No. 3, Aug. 1971.

*Primary Examiner*—George Harris
*Attorney, Agent, or Firm*—Robert S. Smith

[57] ABSTRACT

A thermal switch apparatus includes a housing having an opening with an axially extending face. A first slot extends around at least a portion of the face. A second slot extends around at least a portion of the face. The first and second slots intersect for a portion thereof. The first and second slots each have an axis and the axis of one is disposed in oblique relationship to the other.

5 Claims, 10 Drawing Figures

HOUSING FOR A BIMETALLIC THERMAL SWITCH

BACKGROUND OF THE INVENTION

The invention relates to thermal switches and more particularly to thermal switches operated by a bimetallic element. A wide variety of thermal switches operated by a bimetallic element are known. Typically the bimetallic element is captured between two members along the periphery of the element. This approach has been satisfactory for many applications. For many other applications such a construction is not wholly satisfactory. More particularly, such structures have required relatively large number of parts and a relatively great amount of labor to assemble.

It is an object of the invention to provide apparatus which requires less time to assemble.

Another object of the invention is to provide apparatus which has a smaller number of parts than apparatus which has been used generally in the past.

Still another object of the invention is to provide an entire apparatus which is simple and inexpensive to manufacture.

Yet another object of the invention is to provide apparatus which will have an envelope which is configured so that the final assembly will be physically interchangeable with many thermal switches that had been previously available.

SUMMARY OF THE INVENTION

It has now been found that these and other objects of the invention may be attained in a thermal switch apparatus which includes a housing having an opening having an axially extending face. A first slot extends around at least a portion of the face. A second slot extends around at least a portion of the face. The first and second slots intersect for at least a portion thereof. The first and second slots each have an axis and the first axis and the second axis are disposed in oblique relationship.

In some forms of the invention each slot is substantially planar and the opening may be cylindrical. The slots may be substantially annular. The housing may be manufactured of a plastic resin material.

BRIEF DESCRIPTION OF THE DRAWINGS

The invention will be better understood by reference to the accompanying drawing in which.

DESCRIPTION OF THE PREFERRED EMBODIMENT

Figure 1:
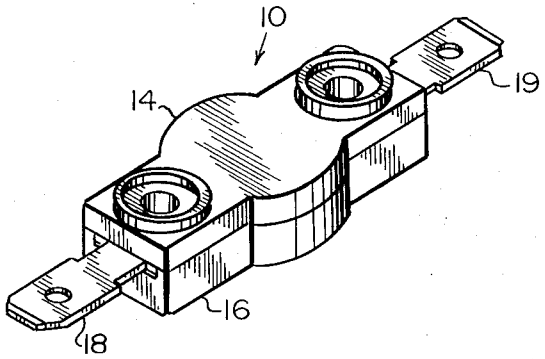
FIG. 1 is a perspective view of a thermal switch in accordance with the invention.
Figure 2:
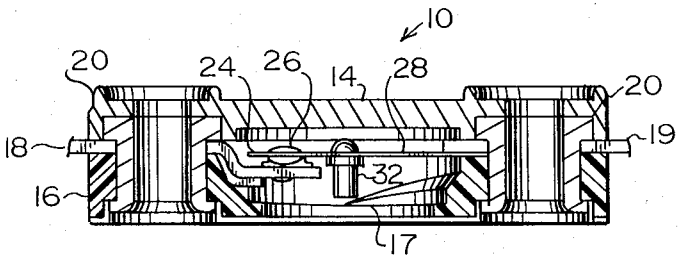
FIG. 2 is a fragmentary sectional view taken along the center line of the thermal switch.
Figure 3:
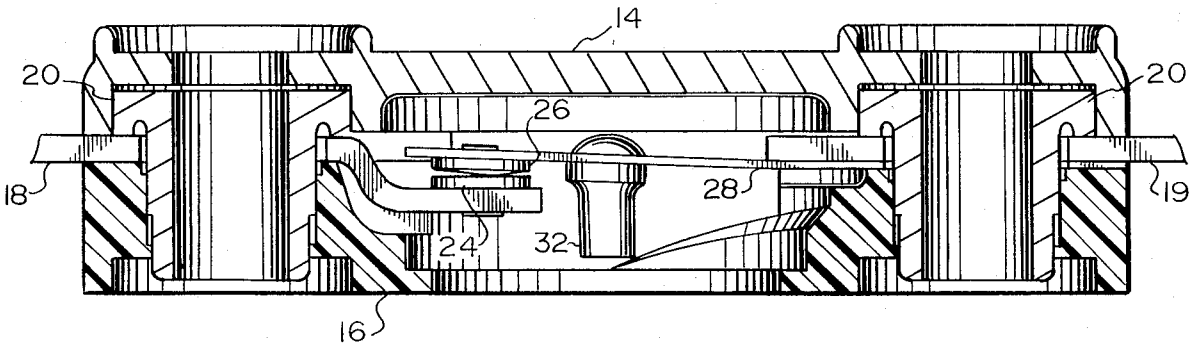
FIG. 3 is another sectional view similar to FIG. 2 except that the bimetallic disc is not shown and the remaining portions of the structure are shown in greater detail.
Figure 6:
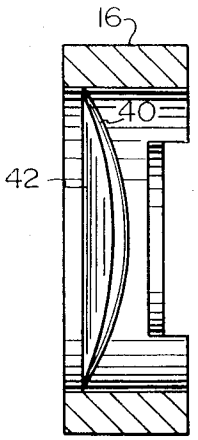
FIG. 6 is a sectional view taken along the line VI—VI of FIG. 5.
Figure 4:
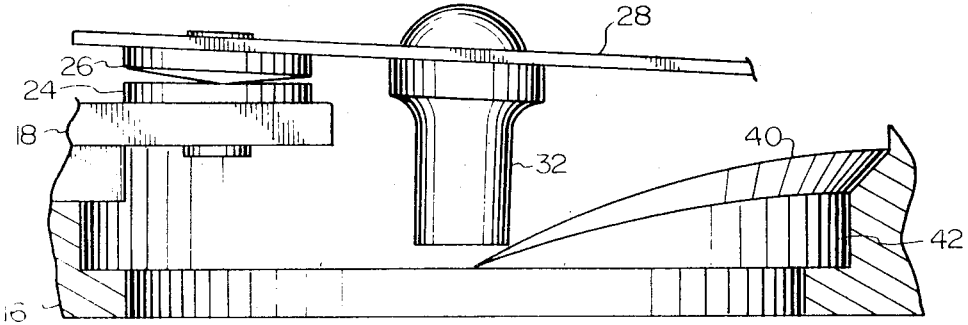
FIG. 4 is a fragmentary enlarged perspective view similar to FIG. 3.
Figure 5:
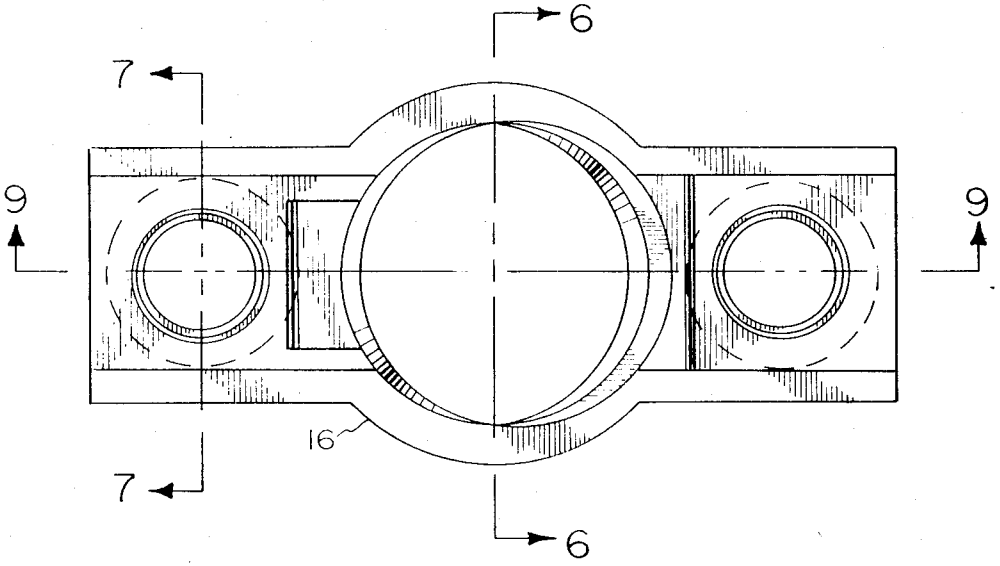
FIG. 5 is a plan view of the disc mounting member.
Figure 8:
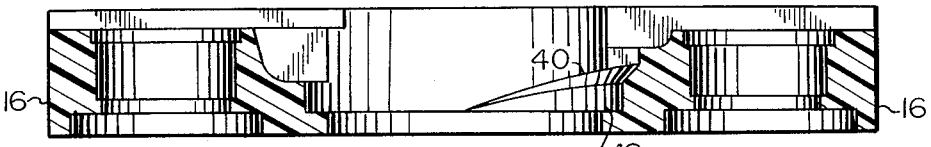
FIG. 8 is a sectional view taken along the line IX—IX of FIG. 5.
Figure 7:
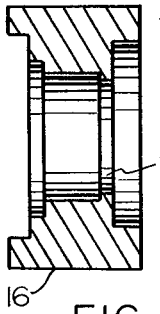
FIG. 7 is a sectional view taken along the line VII—VII of FIG. 5.
Figure 9:
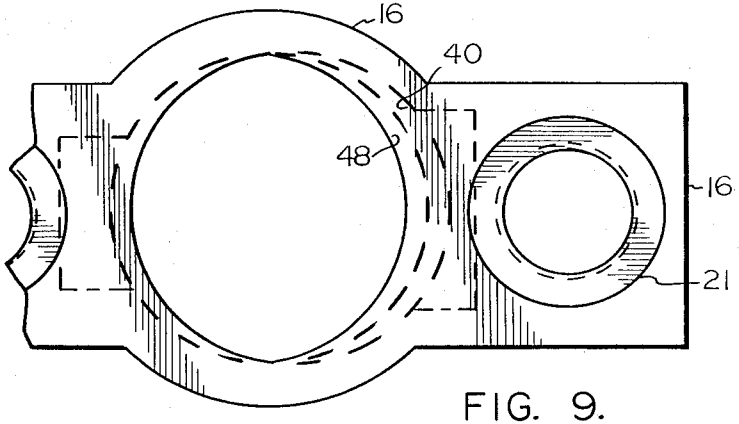
FIG. 9 is a fragmentary plan view similar to FIG. 5.
Figure 10:
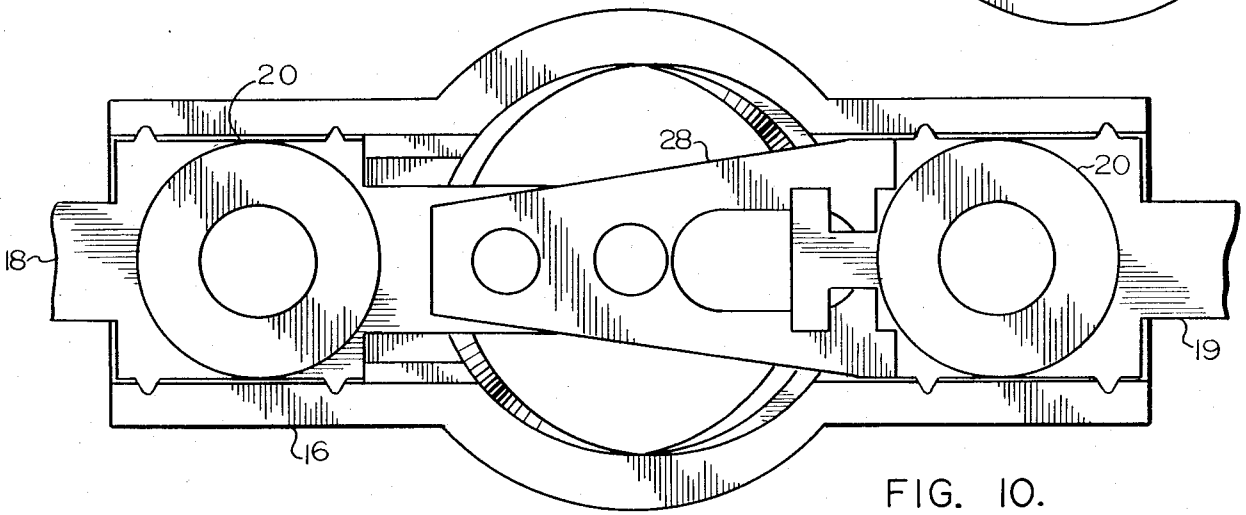
FIG. 10 is a plan view of the disc mounting member after installation of the contact lugs and contact spring assembly.

Referring now to FIGS. 1–10 there is shown a thermal switch 10 in accordance with the invention which includes a disk mounting member or base 16, a cover 14 and connection lugs 18, 19. Carried in the base 16 is a circular bimetallic element 17. The cover 14 and the base 16 are each manufactured of plastic. Similarly, rivets 20, 20 are also plastic and are disposed at substantially the axial extremities of the cover 14 and base 16. The rivets 20, 20 are respectively disposed in countersunk apertures 21, 21. The rivets 20, 20 respectively pass through the contact members 18 and 19. The connection lug 18 includes a stationary contact 24 which cooperates with a moving contact 26 which is carried on a leaf spring 28. The leaf spring 28 is in turn carried on the connection lug 19 which may also be referred to as the moving lugs 19. Extending through the leaf spring 28 is an elongated pusher pin 32. The pusher pin 32 abuts the central area of the bimetallic element 17 which snaps in the conventional manner at a predetermined temperature setting. As will be most apparent from FIG. 2 the snapping of the bimetallic element 17 moves the contact 26 away from the stationary contact 24. The natural bias of the spring 28 causes the contact 26 to engage the contact 24 when the bimetallic element 17 is in the position illustrated in FIG. 2.

The contour of the base 16 is such that during assembly the thermal disk 17 is inserted in an initial annular slot 40 and then moved in a substantially axial direction into a second annular slot 42. The respective axis of the slot 40 and the slot 42 are disposed at an oblique angle as will be apparent from FIGS. 4–10. This construction allows the assembly of the apparatus in a very rapid manner and eliminates the necessity for two separate elements for mounting the bimetallic disk as in the prior art.

Ordinarily the housing 16 and the cover 14 will be manufactured of a plastic resin material. The rivets 20, 20 will also be manufactured of a plastic resin material and will be ultrasonically bonded in place to secure the connection lugs 18, 19 as well as the cover 14 to the base 16. In some embodiments of the invention the disk 17 will have an outline which may be square, rectangular, oval or some other geometric form other than round. Although the housing 16 includes an opening about which the slots 40, 42 are disposed, it will be understood that in some embodiments of the invention a cover may extend over the disk 17 on the base 16. Also, in some embodiments of the invention the connection lugs 18, 19 may extend upwardly or downwardly to meet individual installation requirements. Other connection lug shapes are also contemplated. The base 16 and cover 14 may be manufactured of a ceramic or other non-conductive material and the plastic rivets 20 may be replaced with metal rivets for higher temperature requirements.

What is claimed:

1. A thermal switch apparatus which comprises:

a bimetallic element a housing having means for mounting said bimetallic element in said housing, and for allowing insertion of said bimetallic element in said housing when said thermal switch is fully assembled except for said bimetallic element, said housing comprising a face having an axially extending opening therein, a first slot extending around at least a portion of said face, a second slot extending around at least a portion of said face, said first and second slots intersecting for a portion thereof, said first slot having a first axis and said second slot having a second axis, said first axis and said second axis being disposed in oblique relationship;

first and second electrical contacts; and means for opening and closing said first and second electric contracts responsive to movement of said bimetallic element.

2. The apparatus as described in claim 1 wherein at least a portion of each slot is substantially planar.

3. The apparatus as described in claim 2 wherein said opening is cylindrical.

4. The apparatus as described in claim 3 wherein said slots are substantially annular.

5. The apparatus as described in claim 4 wherein said housing is manufactured of a plastic resin material.

* * * * *

UNITED STATES PATENT AND TRADEMARK OFFICE

CERTIFICATE OF CORRECTION

PATENT NO. : 4,504,814

DATED : March 12, 1985

INVENTOR(S) : CHARLES C. ROBERTS ET AL

It is certified that error appears in the above—identified patent and that said Letters Patent is hereby corrected as shown below:

In the Title Page

The Assignee should be changed to --NORTH AMERICAN PHILIPS CORPORATION--

Signed and Sealed this

*Twenty-seventh* Day of *August 1985*

[SEAL]

*Attest:*

DONALD J. QUIGG

*Attesting Officer* *Acting Commissioner of Patents and Trademarks*